US007052365B2

(12) United States Patent
Dornfeld et al.

(10) Patent No.: US 7,052,365 B2
(45) **Date of Patent: *May 30, 2006**

(54) SEMICONDUCTOR WAFER CHEMICAL-MECHANICAL PLANARIZATION PROCESS MONITORING AND END-POINT DETECTION METHOD AND APPARATUS

(75) Inventors: David A. Dornfeld, Berkeley, CA (US); Jianshe Tang, Albany, CA (US)

(73) Assignee: The Regents of The University of California, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/097,779

(22) Filed: Apr. 1, 2005

(65) Prior Publication Data

US 2005/0215178 A1 Sep. 29, 2005

Related U.S. Application Data

(63) Continuation of application No. 08/869,328, filed on Jun. 5, 1997, now Pat. No. 6,910,942.

(51) Int. Cl.
*B24B 1/00* (2006.01)

(52) U.S. Cl. ..... 451/5; 451/41; 451/8; 451/285; 451/288

(58) Field of Classification Search ..... 451/5, 451/8, 41, 285–289, 57, 58; 73/587; 340/650

See application file for complete search history.

(56) References Cited

U.S. PATENT DOCUMENTS 5,222,329 A 6/1993 Yu
5,240,552 A 8/1993 Yu et al.
5,245,794 A 9/1993 Salugsugan
5,439,551 A 8/1995 Meikle et al.
5,685,766 A 11/1997 Mattingly et al.
6,910,942 B1 6/2005 Dornfeld et al.

OTHER PUBLICATIONS

Y.P. Chang, et al., "An Investigation of the AE Signals in the Lapping Process", *Annals of the CIRP*, vol. 45/Jan. 1996, pp. 331-334.
D. Dornfeld, et al., "Abrasive Texturing and Burnishing Process Monitoring Using Acoustic Emission", *Annals of the CIRP*, vol. 42/Jan. 1993, pp. 397-400.
C.L. Jiaa, et al., "Experimental Studies of Sliding Friction and Wear Via Acoustic Emission Signal Analysis", *Wear*, 139 (1990), pp. 403-424.
A. Fukuroda, et al., "In Situ CMP Monitoring Technique for Multi-Layer Interconnection", *Technical Digest of the International Electron Devices Meeting*, 1995, pp. 469-472.

*Primary Examiner*—George Nguyen
(74) *Attorney, Agent, or Firm*—Townsend and Townsend and Crew LLP

(57) ABSTRACT

The chemical-mechanical polishing (CMP) of products in general and semiconductor wafers in particular is controlled by monitoring the acoustic emissions generated during CMP. A signal is generated with the acoustic emissions which is reflective of the energy of the acoustic emissions. The signals are monitored and the CMP process is adjusted in response to a change in the acoustic emission energy. Changes in the acoustic emission energy signal can be used to determine the end-point for CMP, particularly when fabricating semiconductor wafers for planarizing/polishing a given surface thereof. Long-term changes in the acoustic emission energy signals resulting from process changes including, for example, wear of the polishing pad, can also be detected with the acoustic emission energy signals so that desired or necessary process adjustments, such as a reconditioning of the polishing pad, for example, can be effected or the process can be stopped or an alarm signal can be generated when unacceptable process abnormalities occur.

28 Claims, 4 Drawing Sheets

PATTERNED METAL

CONFORMAL DIELECTRIC DEPOSITION

PLANARIZATION

SEMICONDUCTOR WAFER CHEMICAL-MECHANICAL PLANARIZATION PROCESS MONITORING AND END-POINT DETECTION METHOD AND APPARATUS

This application is a continuation application of U.S. patent application Ser. No. 08/869,328, filed on Jun. 5, 1997 now U.S. Pat. No. 6,910,942, which is herein incorporated by reference in its entirety.

BACKGROUND OF THE INVENTION

This invention relates to the manufacture of semiconductors, and more particularly to a method and apparatus for controlling the chemical-mechanical planarization ("CMP") of semiconductor wafers in real time during the process, and particularly for determining when the end-point of the process has been reached.

As semiconductor devices are scaled down to submicron dimensions, planarization technology becomes increasingly important, both during the fabrication of the device and for the formation of multi-level interconnects and wiring. Chemical-mechanical planarization has recently emerged as a promising technique for achieving a high degree of planarization for submicron very large integrated circuit fabrication.

CMP is currently used for 0.35 μm device manufacturing and is generally viewed as a necessary technology for the manufacture of next generation 0.25 μm devices. Typically, CMP is used for removing a thickness of an oxide material which has been deposited onto a substrate, or on which a variety of integrated circuit devices have been formed. A particular problem that is encountered when a device surface is chemically-mechanically planarized/polished is the determination when the surface has been sufficiently planarized, or when the planarization end-point has been reached because when removing or planarizing an oxide layer it is desirable to remove the oxide only to the top of the various integrated circuit devices without, however, removing any portions of the latter.

In the past, the surface characteristics and the planar end-point of the planarized wafer surface have been detected by removing the semiconductor wafer from a polishing apparatus and physically examining it with techniques with which dimensional and planar characteristics can be ascertained. Typically, commercial instruments such as surface profilometers, ellipsometers, or quartz crystal oscillators are used for this purpose. If the semiconductor wafer being inspected does not meet specifications, it must be placed back into the polishing apparatus and further planarized. This is time-consuming and labor-intensive. In addition, if the inspection occurred too late; that is, after too much material has been removed from the wafer, the part becomes unusable and a reject. This adversely affected the product yield attainable with such processes and techniques.

It would therefore be desirable if a technique were available which permits one to control and terminate semiconductor device CMP processes effectively and efficiently. Some techniques proposed in the past involved utilizing sound generated during CMP for controlling the process and/or determining its end-point.

For example, U.S. Pat. No. 5,245,794 suggests to detect the CMP end-point during semiconductor wafer polishing by sensing acoustic waves which are generated by the rubbing contact between a polishing pad and a hard surface underlying a softer material that is being removed. Wave energy in the range of 35–100 Hz is sensed, converted into an audio signal, processed, and used to determine the end-point for the CMP after the signal has been sensed for a predetermined time.

U.S. Pat. No. 5,240,552 discloses to control a semiconductor wafer CMP by directing sound from an external source against the surface being polished and measuring the transit time of the acoustic waves reflected from the surface. From the latter, a desired characteristic, such as the amount of surface layer removed and/or remaining, can be calculated.

U.S. Pat. No. 5,439,551 discloses several CMP end-point detection techniques, including one that requires that a change in the sound waves emitted during polishing be detected and that polishing cease upon the detection of the change. A microphone-like, noncontact pick-up detects audible sound generated by the action of the polishing pad against the workpiece in the presence of a slurry. Although not specifically set forth in the '551 patent, it suggests that audible frequencies of sound are being measured because the patent discloses, amongst others, that the frequency of sound signals can be tailored.

A still further approach for determining the CMP end-point is disclosed in U.S. Pat. No. 5,222,329. One aspect of this patent discloses to determine an interface end-point by detecting acoustic waves which develop a certain sound intensity versus frequency characteristic when the metal/underlayer interfaces are about to be reached in a CMP process. In other words, the signal amplitude in a certain frequency band is used to determine the end-point.

Another aspect of the '329 patent suggests to determine the end-point on the basis of a given material thickness by measuring the frequency of the acoustic waves generated by the CMP process and comparing the signals in a spectrum analyzer with known (or pre-established) frequency characteristics for the materials in question.

Although these prior art approaches provide certain improvements over earlier end-point detection techniques employing physical and/or optical measuring instruments, for example, they have their shortcomings. In some instances, the detected signals require complicated processing; in others, they require the storage of characteristic data for any given material before it can be measured, and all of them require relatively intricate, sensitive and therefore costly controls and instruments.

SUMMARY OF THE INVENTION

In contrast to the prior art, the present invention uses acoustic emissions ("AE") for controlling the progress of and/or determining the end-point for a CMP process during semiconductor polishing.

For purposes of the present application, AE refers to the group of phenomena where transient elastic waves are generated by the rapid release of energy from localized sources within a material. The fundamental difference between AE and the field generally referred to as "ultrasonics" is that AE is generated by the material itself, while in "ultrasonics" the acoustic wave is generated by an external source and introduced into and/or reflected off the material. AE can be generated by a large number of different mechanisms, including, for example, the fracture of crystallites, grain boundary sliding, friction, liquefaction and solidification, dissolution and solid-solid phase transformation, leaks, cavitation, and the like.

"Ultrasonics" refers to a nondestructive, passive testing technique in which acoustic waves, typically but not necessarily ultrasonic waves, are directed against the surface of an object. The reflected waves are then observed and used to determine one or more physical characteristics of the object such as, for example, a thickness, a surface condition or the like.

AE, which involves frequencies in the range of between about 50–1,000 kHz, is different and must be distinguished from audible sound which is typically in the range of between 1 kHz to 20 kHz. The former refers to high frequencies, including ultrasonic frequency waves such as stress waves, for example, which propagate through a structure due to a release of energy by the structure, and which are in the range of about 50 kHz to about 1 MHz.

In particular, the present invention detects and utilizes the energy of AE to control and/or determine the end-point of CMP processes in general and the CMP of semiconductor wafers in particular.

The inventors and others have previously recognized that AE is quite sensitive to the change in friction and wear mechanisms in sliding processes. For example, one of the coinventors, in collaboration with others, previously discovered that a dry texturing process for hard disks can be divided into four stages and that acceptable texture surfaces exist only in the first two stages, based on measured AE and forces. It is also known that AE signals are sensitive to surface geometry variation when sliding motion is involved.

Research has shown that AE can be used for monitoring the material removal rate and/or observing a reduction in the removal rate due to changes in abrasive size with lapping time.

The inventors therefore theorized that AE might be useful in the control of CMP and particularly its end-point detection, for products in general and especially for modern semiconductor devices which have several layers, including an interlayer dielectric used for insulation. Such devices usually need to be planarized for the next litography step in the manufacture of the device. For example, in a logic device having five or more layers, at least one layer should be perfectly planar.

Interlayer dielectric planarization has become more critical as the number of metal stack layers has increased. While numerous traditional planarization technologies are available, it is generally agreed that conventional technologies primarily smooth the topography locally and have little or no effect on global planarization. CMP is presently the only planarization technology known to provide global planarization of topography with low post planarization slope.

The manufacture of semiconductor devices initially involves the formation of metal interconnections which are covered with an insulator film. This is followed by a planarization process to eliminate the topography in the dielectric material and remove all upward projections or hills from the surface. Surfaces which protrude above the surrounding topography have a higher removal rate than do lower surfaces. Smaller features are rounded off and polished faster than larger features.

During CMP, there are several sources which emit AE. For example, since surface characteristics of the dielectric layer directly affect the interaction between slurry particles and the dielectric layer, there are two potential AE sources in the beginning of the process, namely slurry particle-dielectric layer abrasion and slurry particle-trench impact. Further, a change of friction occurs when the first (e.g. dielectric) material has been removed to be planar and the second, underlying material becomes exposed. At the beginning of CMP, the brittle-brittle material interaction area is relatively large. Since both brittle-brittle materials abrasion and trench impact are likely to generate relatively more acoustic emissions, in particular more AE energy, for example, than are generated after CMP is finished, the generated AE energy is higher at the beginning of CMP than at the end. After the surface is planarized, the major AE sources will be particle-dielectric abrasion and particle-metal abrasion. Particle-metal abrasion generates relatively fewer acoustic emissions as the brittle-brittle interaction surface area becomes smaller when the CMP is nearly complete. As a result, the generated AE energy was found to be significantly lower when the CMP end-point is reached than at the start of CMP.

In accordance with the present invention, the sudden, sustained drop or reduction in the generated AE energy signals that is encountered when the CMP end-point has been reached is used to terminate CMP at the appropriate point of the CMP process.

In its broadest aspect, therefore, the present invention involves a method for terminating and/or controlling a chemical-mechanical polishing operation on a workpiece such as a semiconductor wafer having a surface to be polished. The method involves monitoring acoustic emission energy generated during CMP and terminating the CMP in response to detecting a significant change such as a sharp drop in the acoustic energy emission and/or adjusting the CMP in response to other changes in the AE energy.

In a presently preferred embodiment of the invention, the AE energy is sensed with a transducer that monitors the AE energy resulting from the relative movement between the wafer surface and a polishing pad. The transducer is attached to the back side of the head holding the wafer or of the polishing pad which faces away from the wafer. When the drop in the AE energy is sensed by the transducer, CMP is terminated.

Preferably, the AE energy is measured as the "rms" (root mean square) voltage (Vrms) of the raw AE signal or a continuous AE count rate of the Vrms signal, although, if desirable, other ways of determining the energy of the AE signal, generally defined as the integral of the amplitude of the signal over a time period, can be used.

The CMP end-point detection of the present invention is particularly useful for semiconductor device trench isolation structure CMP. Trench structures are utilized in advanced IC fabrication to prevent latch-up and to isolate the n-channel from p-channel devices in CMOS circuits, to isolate the transistors of bipolar circuits, and to serve as storage-capacitor structures in DRAMs. Trenches are attractive for several reasons, for example, because they allow circuitry to be placed closer together, thereby using space more efficiently without adversely impacting device performance.

The present invention is also particularly suited for damascene structure CMP. The semiconductor industry is currently moving towards the use of metal damascene processes for the wiring of circuits on chips because metal damascene can achieve the minimum interconnect pitch to thereby increase wiring density. Usually damascene processes include the steps of etching vias and trenches into dielectric layers, filling the features with metal, and CMP polishing to form a planarized, embedded surface. It is anticipated that damascene architectures will become an increasingly important option for wireability of sub 0.25 μm generation interconnects.

The manufacture of a damascene structure typically involves three separate CMP processes, one for the formation of vertical interconnections (plugs), one used during the formation of the horizontal interconnects (lines), and another one for the planarization of the wafer. In each instance the AE energy emissions will vary between the beginning and the end of the CMPs quite similarly. Thus, the end-point detection of the present invention for interlayer dielectric CMPs is ideally suited for trench isolation structures and damascene structures.

Since AE energy monitoring and resulting signal processing is relatively simple and effective, and since for the above summarized reasons there will almost always be a pronounced and sustained change in the energy output when the interface of two materials is reached, the AE energy control of CMP in accordance with the present invention constitutes a significant improvement in monitoring the overall CMP process and establishing its end-point.

DESCRIPTION OF THE PREFERRED EMBODIMENTS

Figure 1A:
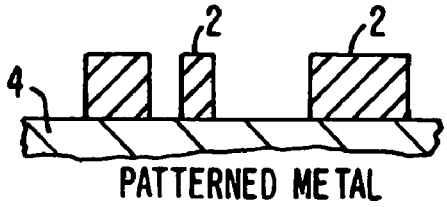
FIGS. 1A–1C schematically illustrate the planarization of a semiconductor wafer.
Figure 1B:
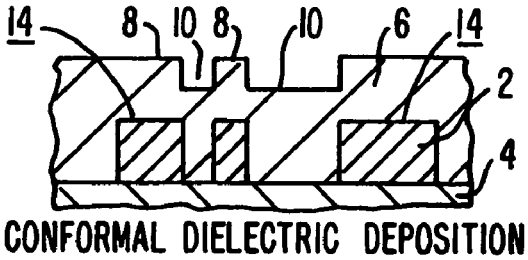
Figure 1C:
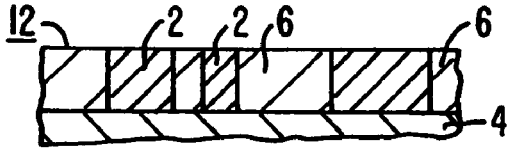

FIGS. 1A–C schematically illustrate why surface planarization, which typically also includes or leads to surface conditioning such as polishing, is needed during the manufacture of semiconductor devices. After a patterned metal structure 2 is formed on a substrate or existing layer 4 of the device, a dielectric material 6, such as an oxide, is deposited on top of it (for example, by a chemical vapor deposition (CVD) technique). The dielectric layer conforms to the underlying surface (defined by the metal structure and substrate) and will form peaks 8 and valleys 10. Before the next layer can be applied, the dielectric material must be removed down to the top surface 14 of the semiconductor structure and planarized to define a flat and typically polished surface 12. The latter is accomplished by CMP in accordance with the present invention.

Since wafer thickness in general and the thickness of dielectric layer 6 in particular cannot be measured while CMP is in progress, it is difficult to determine at what point the planarized surface 12 is flush with top surface 14 of the patterned metal structure. With the present invention, this determination can be made in real time by monitoring the acoustic emissions generated as CMP progresses. As was mentioned above, there will be a significant and lasting change in the energy of the acoustic emissions when the CMP reaches the top surface of the metal structure. When this change occurs, the CMP is terminated.

Figure 5:
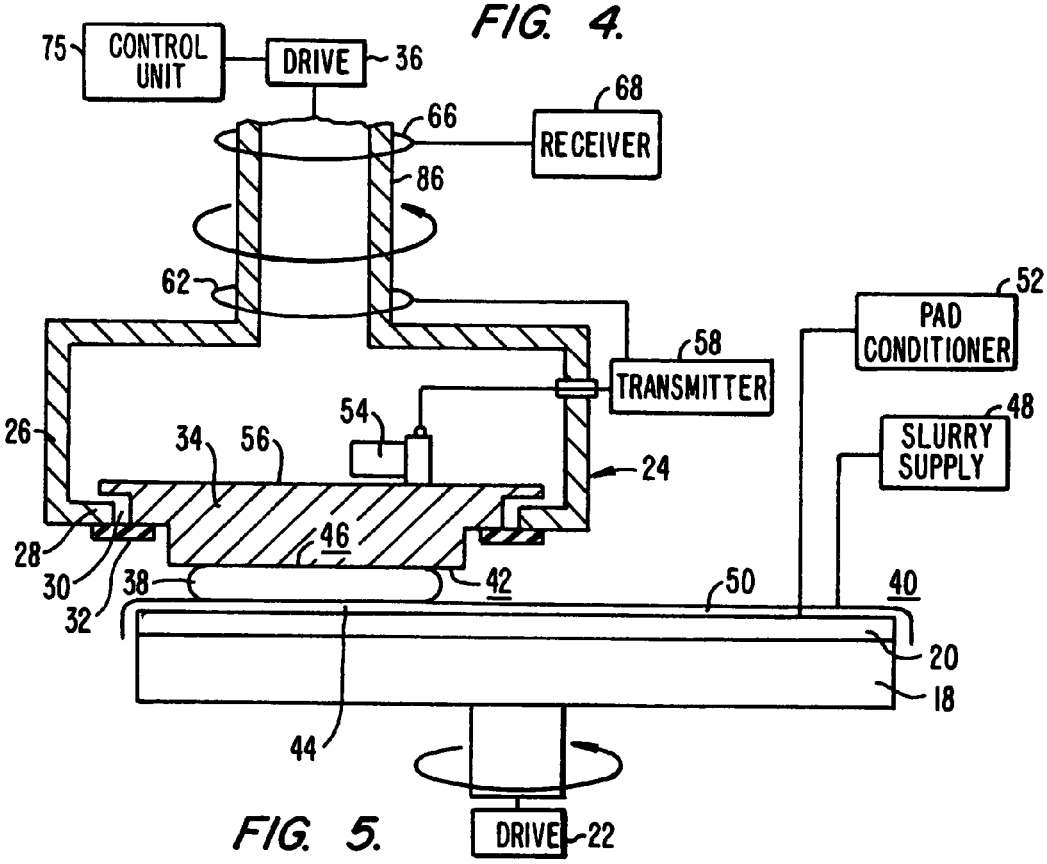
FIG. 5 is a fragmentary, enlarged, schematic front elevational view through an apparatus constructed in accordance with the present invention for the CMP of a semiconductor wafer.

Referring to FIG. 5, a typical CMP machine 16 includes a horizontal turntable 18 which holds a preferably porous polishing pad 20 made, for example, from neoprene or a similar, somewhat resilient material. A drive 22 rotates the turntable about its vertical axis.

A wafer holder 24 is located above the turntable and forms a chamber 26 with a lower end plate 28 that includes a downwardly open cutout 30. A head 34, made, for example, of aluminum, protrudes through the cutout and is resiliently suspended from the lower end plate of the chamber by a flexible ring 32 made, for example, of rubber or neoprene. Another drive 36 rotates wafer holder 24 about its upright axis and is controlled by control unit 75.

A semiconductor wafer 38 (or other workpiece that requires CMP) is disposed between the upwardly facing surface 40 of the polishing pad 20 and a downwardly oriented surface 42 of the wafer holder.

To planarize, a given surface 44 of the wafer is attached to the under side 42 of head 36, for example by applying a wafer-holding vacuum, placing a thin polyurethane film between the wafer and the under side of the head which acts as a light adhesive, or by other suitable means. The wafer holder 24 is then lowered (or turntable 18 is raised), and a slurry including an appropriate abrasive (in the form of small (e.g. 0.3μ) abrasive particles is flowed from a slurry supply 48 to form a thin abrasive slurry layer 50 over the top surface of the polishing pad. The wafer is pressed against the under side 42 of head 34 and the top surface of the polishing pad in an accurately controlled manner (as is well known in the industry) to limit and control the forces between them. Typically, the pressure between the opposing surfaces of the wafer and the polishing pad should not exceed about 9 psi. Drives 22 and 36 rotate the turntable and the wafer holder, respectively, about their axes and may include drive units (not separately shown) for rotating the holder about dual, spaced-apart parallel axes or for adding linear motion to the rotational movement of the holder (not shown). The rotation of the polishing pad assists in carrying the slurry deposited on the pad to the wafer (which is positioned off-center on the pad as shown in FIG. 5).

Generally, the slurry is selected so that it chemically attacks the wafer surface to facilitate its removal by the abrasives in the slurry. Thus, for planarizing silicon layers on semiconductor structures, for example, a suitable slurry is preferably one which converts the silicon layer into a hydroxilated form. Such a slurry is commercially available and has colloidally suspended silica in a high pH (10.7) aqueous solution of $NH_3OH$ with a mean particle diameter of 140 nm and 13% (by weight) solids. For other materials, such as oxides or metals, for example, slurries having the same or similar effect on the material being planarized are selected, as is well known to those skilled in the art.

A pad conditioner 52 can be provided for maintaining the upper surface 40 of polishing pad 20 in the desired state.

CMP machine 16 includes a sensor or transducer 54 for monitoring and picking up acoustic emissions generated in the wafer while CMP is in progress. The sensor is preferably of the type which uses either a piezo electric ceramic element or a thin film piezo electric element. In one preferred embodiment of the invention, the sensor is attached to a back side 56 of wafer holding head 34 so that it becomes integrated with the head and can pick up AE waves generated by the wafer during CMP. If desired, the sensor can also be attached to the back side of turntable 18. It generates signals which are a function of the acoustic emissions picked up by it. For the needed subsequent signal processing, holder 24 preferably includes a transmitter 58 for feeding the picked-up AE signals to a receiver 60 via spaced-apart ring antennas 62, 64 located, for example, about a drive shaft 86 of holder 24.

Figure 6:
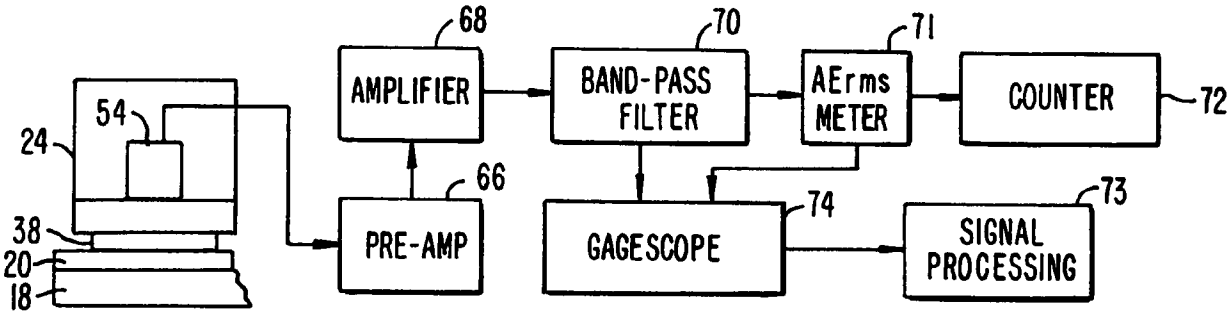
FIG. 6 schematically illustrates an instrumentation set-up for monitoring the CMP process.

Referring now to FIGS. 5 and 6, the AE signals received by transmitter 58 can be processed, for example, by directing them to a preamplifier 66 (which may form part of sensor 54 or transmitter 58 to amplify the output signals of the transducer before they are transmitted to the receiver), an amplifier 68, and then a band pass filter 70 with a pass band between about 50–1000 kHz. The amplifiers might provide, for example, a total gain of 60 dB. The output of the filter can be fed to a digital or analog AErms voltage meter 71 for measuring the energy component of the AE waves picked up by sensor 54. Its output can in turn be fed to an AE counter 72 for generating a continuous AE count rate. Separately therefrom, the output of filter 70 can be fed to a Gage Scope data acquisition board 74 which, for example, samples the analog signals from the filter at 5 MHz. The output of the data acquisition board is then further processed to determine the AE energy generated in the wafer while CMP is in progress. In another embodiment of the invention, the output of the AErms meter 71 is directed to the Gage Scope. The latter samples the AErms signals and generates signals which are processed in a processor 73 that is operatively coupled with the control unit 75 for adjusting one or more CMP parameters to maintain steady state CMP operations and/or to terminate CMP once its end-point has been reached.

Figure 2:
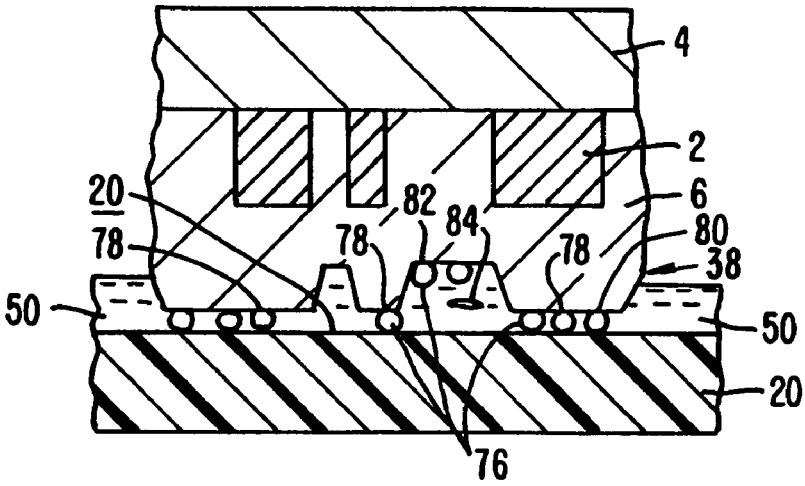
FIG. 2 is a fragmentary, schematic illustration of the major acoustic emission sources in a CMP process.

FIG. 2 illustrates the major sources for acoustic emissions generated in a CMP process. As was described earlier, the wafer 38, including its substrate 4, patterned metal structure 2 thereon, and dielectric layer 6 deposited over the metal structure, is placed on top of polishing pad 20 and, during CMP, is pressed against the polishing pad by wafer holder 24 (not shown in FIG. 2). During CMP, the polishing pad and the wafer holder rotate (which may include a linear motion component) to generate relative motion between the opposing surfaces of the dielectric layer and the upper surface 40 of the pad. Abrasive particles 76 suspended in the slurry layer 50 become lodged between these surfaces and while the chemically active slurry preferably conditions (e.g. softens) the dielectric layer, the particles will abrade and thereby remove the dielectric and in the process reduce its thickness.

In this process, the following are primary AE sources:

- AE at 78 resulting from two-body abrasion (between abrasive particles 76 and dielectric material 6) as well as microscratching of the dielectric surface;
- AE at 80 resulting from the dissolution of the dielectric (or other material) under load at 80;
- AE at 82 resulting from elastic impact, microindentations (of the dielectric) and three-body abrasion in areas where the abrasive particles contact the dielectric and the slurry but not the polishing pad; and
- AE at 84 resulting from the dissolution of abraded dielectric (or other material) chips.

There are other AE sources but their emissions are typically of a relatively lesser magnitude as compared to the sources mentioned above.

As has already been mentioned, AE energy can be conveniently determined on the basis of the rms voltage of the picked-up raw AE signals. A preferred way of doing this is by determining the magnitude of the rms voltage (Vrms) according to the following equation:

$$V_{\mathrm{rms}} = \left(\frac{1}{\Delta T}\int_0^{\Delta T} V^2(t)dt\right)^{1/2}$$

wherein: V=voltage of the acoustic emissions signal t=time

ΔT=sampling interval.

Alternatively, a close approximation of Vrms can be obtained on the basis of a continuous count rate for either the raw AE signal or the Vrms signal. The count rate reflects the state of the CMP process and can be used to determine the magnitude of the AE energy with a high degree of accuracy because of the relationship between the rms voltage and the count rate. The count rate is the number of times the signal crosses a predetermined, fixed threshold voltage in a unit of time. The following equation shows the relationship between the count rate and the rms voltage:

$$\dot{N}=f\cdot e^{-(V_t^2/\alpha(V_{rmsM})^2)}$$

wherein: $\dot{N}$=count rate f=frequency $V_t$=threshold voltage of the counter e=base of natural logarithm and is approximately 2.71828

$\alpha$=2 for peak amplitude probability density function represented by a Rayleigh distribution, and $V_{rmsM}$=measured root mean square voltage.

Thus, a sudden, lasting drop in the count rate, for example, is indicative that the CMP end-point has been reached. One of the principal advantages of using the count rate for determining the magnitude of the AE energy is that it is easy to measure.

While CMP is in progress, the rms voltage, the AE continuous count rate, or another measurable component of the rms voltage which reflects the state of the CMP process are continuously monitored, thereby also monitoring the AE energy generated by the process. When there is a sudden change in the monitored signals, for semiconductor wafer CMP usually a sudden and lasting drop in the magnitude of the monitored signals, the end-point of CMP is reached because the signals indicate that the CMP process has removed the dielectric so that it is flush with the top of the underlying metal structure.

Figure 4:
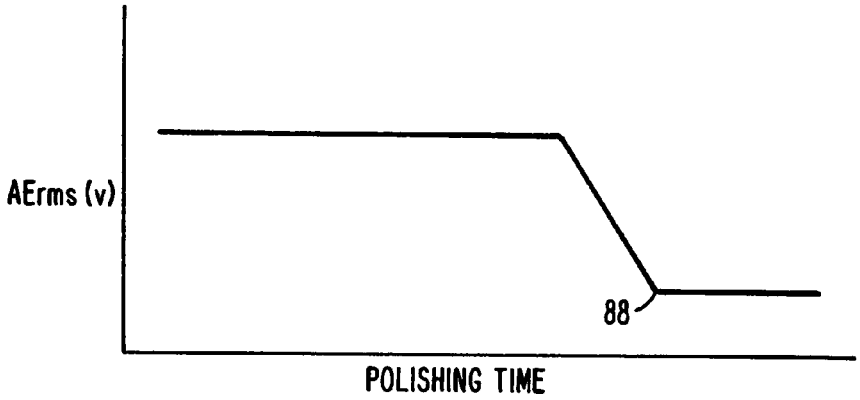
FIG. 4 is a diagram which illustrates the relationship between AErms and the polishing time during a CMP process and illustrates the end-point of the process detected in accordance with the present invention.

FIG. 4 illustrates the relationship between the magnitude of the AE signal energy emissions, and therefore also of the monitored $V_{rms}$ signals, for example, and time. Assuming a constant material removal rate, the signal remains substantially constant over time until the dielectric layer thickness has been reduced such that the top surface of the underlying patterned metal structure, for example, is approached. The signal magnitude then drops rapidly and becomes constant again after steady state CMP takes place again, thereby signalling that the end-point 88 has been reached. After the CMP end-point, the AE signal will have a significantly reduced magnitude because the abrasive particles now abrade not only the relatively brittle oxide layer, but also the exposed metal structures which exhibit significantly less friction, chatter and the like than the brittle oxide. This drop in the AE energy is detected by the transducer, processed, and used in real time to terminate CMP. As a result, the surface will be planarized and the dielectric layer will be flush with the top surface of the underlying layer without removing any noticeable part of the latter.

Figure 3:
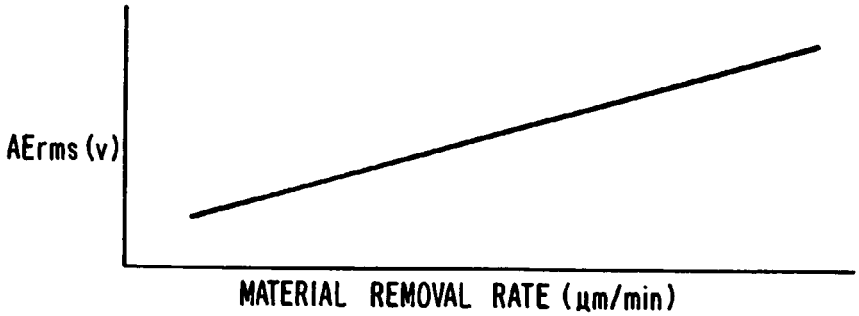
FIG. 3 is a diagram which illustrates the relationship between AErms and the material removal rate in a CMP process.

FIG. 3 illustrates the relationship between the rms voltage, and therefore the AE energy generated by the CMP, and the material removal rate for a dielectric layer of a semiconductor wafer. It shows that the magnitude of the rms voltage is directly related to and varies as a function of the material removal rate. Thus, during steady state CMP, the rms voltage for a given material and material removal rate remains constant.

This can be employed in accordance with the present invention to detect long-term changes resulting, for example, from the wear of the polishing pad, a change in the polishing pressure applied to the wafer, a change in the composition of the slurry, and the like. Such changes typically develop slowly over time while multiple wafers are polished. In contrast, when the CMP end-point is reached, there is the sudden change (drop) in the AE energy.

By monitoring long-term changes in the AE energy generated during CMP of typically multiple wafers during otherwise steady state operations (e.g. while only the dielectric layer is removed), necessary adjustments to the process can be made whenever the long-term changes exceed a preestablished limit. Thus, the present invention not only permits one to actively and instantaneously detect the CMP end-point, by monitoring the steady state portion of CMP from one wafer to the next, changes in the process can be detected and corrective action can be taken before serious problems arise, thereby reducing the likelihood of fabricating rejects.

Figure 7B:
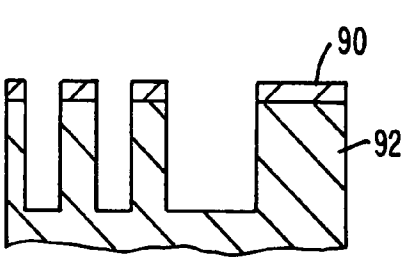
FIGS. 7A–7D illustrate the process sequence for forming a trench isolation semiconductor structure in accordance with the present invention.
Figure 7A:
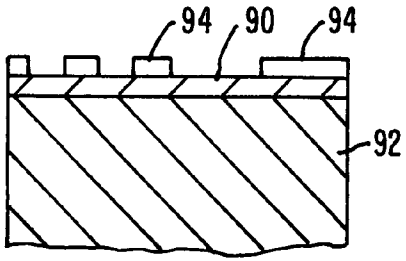
Figure 7D:
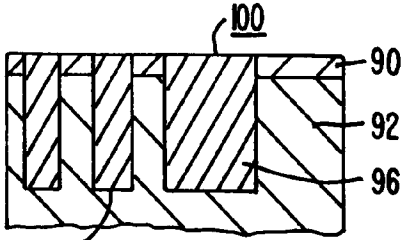
Figure 7C:
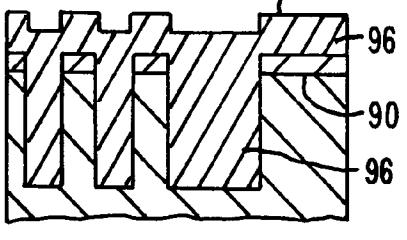

Referring now to FIGS. 7A–D, CMP can be employed in accordance with the present invention for the fabrication of semiconductor trench isolation structures, for example. As is shown in the drawings, a $Si_3N_4$ layer 90 on top of a silicon wafer 92 is appropriately masked at 94 (FIG. 7A), followed by conventional trench etching (FIG. 7B). An oxide layer 96 (FIG. 7C) is then deposited (e.g. by CVD) over the wafer, which, where the layer overlies the masking, includes upwardly projecting peaks 98. Thereafter, the wafer is subjected to CMP planarization in accordance with the present invention to remove the entire oxide layer above the top surfaces of the remaining $Si_3N_4$ portions to define a flat, planarized and polished wafer surface 100.

Figure 8A:
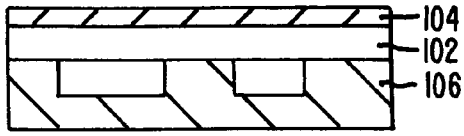
FIGS. 8A–8H illustrate the process sequence for forming a three-level damascene structure in accordance with the present invention.
Figure 8B:
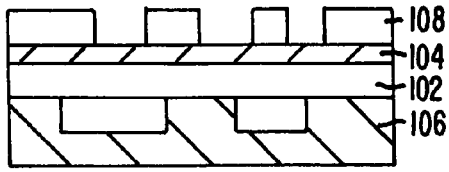
Figure 8C:
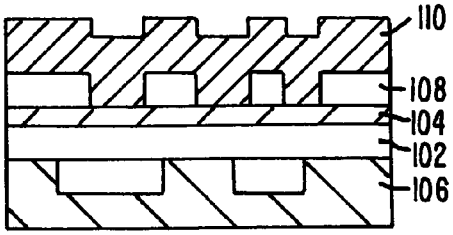
Figure 8D:
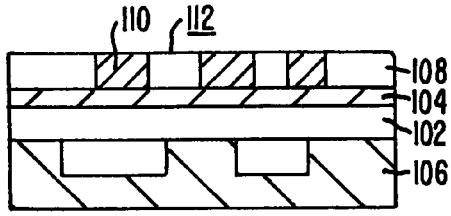

FIGS. 8A–H illustrate the use of CMP in accordance with the present invention in the fabrication of three or more level damascene semiconductor structures, for example. Initially, a first interlayer dielectric ("ILD") 102 and a SiN layer 104 are conventionally deposited over a substrate (FIG. 8A). A second interlayer dielectric 108 is next applied and trench edged (FIG. 8B) followed by the deposition of a metal layer (e.g. Al, Cu or W) 110 (FIG. 8C). The metal layer is then subjected to a CMP process until its end-point is detected where the top surface of the metal layer is flush with the top surface of the second ILD 108 to define a planarized intermediate surface 112 (FIG. 8D).

Figure 8E:
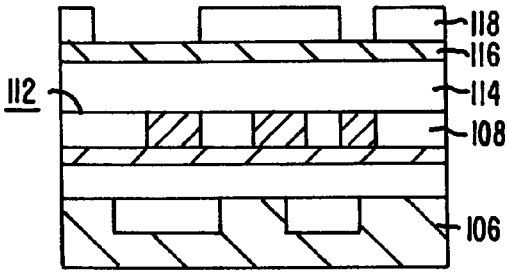
Figure 8F:
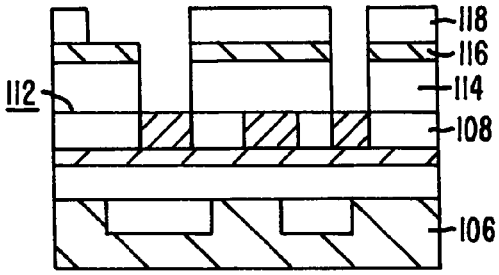
Figure 8G:
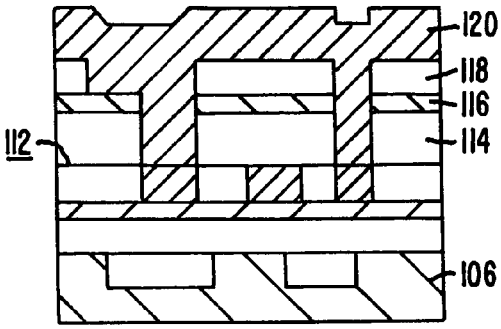
Figure 8H:
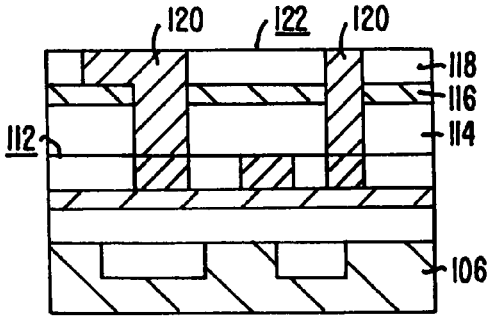

Thereafter, a third ILD 114 is conventionally deposited over planarized surface 112, followed by the deposition of a further SiN etch stop layer 116 and a fourth ILD 118. The latter is masked and etched (as shown in FIG. 8E), which is followed by conventional trench etching (FIG. 8F) and the deposition of a further metal layer 120 (which, for example, may again be Al, Cu or W) (FIG. 8G). The second metal layer is subjected to another CMP until the end-point is reached when a planarized surface 122 is formed that is flush with the top surface of the fourth ILD 118 (FIG. 8H).

What is claimed is:

1. A method for controlling a chemical-mechanical polishing operation on a workpiece having a surface to be polished, the method comprising the steps of providing a slurry including abrasives and a liquid, polishing the workpiece, monitoring acoustic emission energy generated at frequencies above 50,000 Hz during polishing, detecting a sudden and lasting change in the acoustic emission energy, and terminating the polishing step in response to detecting the sudden and lasting change in the acoustic emission energy.

2. A method according to claim 1 wherein the step of detecting a sudden change in the acoustic emission energy comprises detecting a drop in the acoustic emissions energy.

3. A method according to claim 1 wherein the workpiece comprises a semiconductor wafer.

4. A method according to claim 1 wherein the workpiece comprises a semiconductor wafer having a trench structure.

5. A method according to claim 1 wherein the step of polishing is performed sequentially on a plurality of workpieces, and including the step of adjusting the polishing step in response to detecting a relatively gradual change in the acoustic emission energy over a period of time commencing with the polishing of a first one of the plurality of workpieces, and wherein the change in the acoustic emission energy is detected after the polishing of the first one of the workpieces has ended.

6. A method according to claim 1 wherein the workpiece comprises a damascene structure semiconductor wafer.

7. A method according to claim 1 wherein the step of chemically-mechanically polishing the wafer comprises a plurality of separate chemical-mechanical polishing steps performed on the wafer, and including the step of subjecting the wafer to at least one other manufacturing step between the plurality of separate polishing steps.

8. A method according to claim 7 wherein the step of performing a plurality of separate chemical-mechanical polishing steps comprises performing at least two chemical-mechanical polishing steps.

9. A method according to claim 1 wherein the step of monitoring comprises generating an acoustic emission signal with the acoustic emissions, and determining an rms voltage of the acoustic emission signal.

10. A method according to claim 1 wherein the step of monitoring comprises generating acoustic emission signals with the acoustic emissions, and determining a continuous count rate for the acoustic emission signals.

11. A method of determining an end-point of a chemical-mechanical polishing of a semiconductor having a side defined by a first, exposed layer and a second layer covered by the first layer and carried on a substrate of the semiconductor, the method comprising the steps of contacting the first layer with a chemical-mechanical polishing pad, placing a liquid including an abrasive at an interface between the first layer and the polishing pad, the liquid being selected to chemically affect a material of the semiconductor which forms the side of the semiconductor, moving the first layer relative to the polishing pad to thereby reduce a thickness of the first layer while polishing its surface, monitoring acoustic emission energy resulting from frequencies above 50,000 Hz due to the relative movement between the first layer and the pad including chemical interactions between the liquid and the material, detecting a sudden and lasting drop in the acoustic emission energy which is indicative that the thickness of the first layer has been sufficiently reduced so that the polishing pad is in a vicinity of an interface between the first and second layers, and determining that the end-point of the chemical-mechanical polishing has been reached after detecting the sudden and lasting drop in the acoustic emission energy over a predetermined length of time.

12. A method of terminating a chemical-mechanical polishing (CMP) of a semiconductor on a CMP machine, the semiconductor having a side defined by a first, exposed layer and a second layer covered by the first layer and carried by a substrate of the semiconductor, the method comprising the steps of contacting the first layer with a chemical-mechanical polishing pad, placing a liquid capable of chemically affecting at least one of the layers at an interface between the first layer and the polishing pad, moving the first layer relative to the polishing pad to thereby reduce a thickness of the first layer while polishing its surface, attaching an acoustic emissions transducer responsive to frequencies above 50,000 Hz to a part of the CMP machine in contact with the semiconductor, with the transducer monitoring the acoustic emissions resulting from frequencies above 50,000 Hz due to the relative movement between the first layer and the pad, detecting a sudden and lasting change in the energy of the acoustic emissions which is indicative that the thickness of the first layer has been sufficiently reduced so that the polishing pad is in a vicinity of an interface between the first and second layers, and terminating the chemical-mechanical polishing substantially immediately after detecting the sudden and lasting change in the acoustic emission energy.

13. A method according to claim 12 wherein the part of the CMP machine comprises a holder of the CMP machine, and including the step of generating a force biasing the holder and the wafer against each other to thereby further bias the wafer and the polishing pad against each other.

14. A method for determining an end-point of a chemical-mechanical polishing operation on a wafer of a multi-level semiconductor device comprising a plurality of thin film layers deposited on top of each other, the method comprising the steps of pressing a surface of the wafer to be polished against a polishing pad; placing a slurry including an abrasive and a liquid which chemically affects the thin film layer forming at least part of the wafer surface between the wafer surface and the pad; removing material of a top film layer by moving the wafer relative to the pad to thereby chemically-mechanically polish the wafer side and cause acoustic emissions having a frequency above 50,000 Hz to emanate from the wafer resulting from mechanical contact between the abrasive and the wafer surface and chemical interaction of the thin film layer with the liquid; generating acoustic emission signals from the acoustic emissions; monitoring the acoustic emission signals; extracting at least one of an acoustic emission energy component and a continuous acoustic emission count rate component of the signals; detecting a sudden and lasting change in at least one of the extracted acoustic emission components; and terminating the step of removing in response to detecting the sudden and lasting change in the acoustic emission energy.

15. A method according to claim 14 wherein the step of extracting comprises extracting the acoustic energy component, and wherein the step of detecting comprises determining an integral of an amplitude of the acoustic emission energy component over a period of time.

16. A method according to claim 14 wherein the step of extracting comprises extracting the acoustic energy component by determining a root mean square (rms) voltage ($V_{rms}$) of the signals so that $$V_{\text{rms}} = \left(\frac{1}{\Delta T}\int_0^{\Delta T} V^2(t)dt\right)^{1/2}$$

wherein: V=voltage of the acoustic emissions signal t=time

ΔT=sampling interval.

17. A method according to claim 14 wherein the step of extracting comprises extracting the continuous acoustic emission count rate component, and wherein the step of detecting comprises determining the number of times the acoustic emissions count rate component crosses a predetermined threshold level for the acoustic emission signals over a period of time, and terminating the step of removing when a predetermined change in the count rate has occurred.

18. A method according to claim 14 wherein the continuous acoustic emission count rate component is related to the acoustic energy component of the signals so that $$\dot{N}=f\cdot e^{-(V_t^2/\alpha(V_{rmsM})^2)}$$

wherein: $\dot{N}$=count rate f=frequency $V_t$=threshold voltage of the counter e=base of natural logarithm and is approximately 2.71828

$\alpha$=2 for peak amplitude probability density function represented by a Rayleigh distribution, and $V_{rmsM}$=measured root mean square voltage of the acoustic signals.

19. A method according to claim 14 wherein the step of causing the acoustic emissions comprises generating the acoustic emissions with at least one of abrasive slurry particles impacting on the wafer side and slurry particles scratching the wafer side, and at least one of dissolving chips abraded from the wafer side and dissolving material of the wafer forming the wafer side.

20. A chemical mechanical polishing apparatus comprising:

a polishing pad for polishing a workpiece;

a drive adapted to move the polishing pad;

a sensor adapted to monitor acoustic emission energy generated at frequencies above 50,000 Hz during polishing and detecting a sudden and lasting change in the acoustic emission energy, and a control unit adapted to cause the drive to terminate the polishing in response to detecting the sudden and lasting change in the acoustic emission energy.

21. A chemical mechanical polishing apparatus according to claim 20 wherein the workpiece is a semiconductor wafer.

22. A chemical mechanical polishing apparatus according to claim 20 further comprising a slurry supply containing a slurry that is used to polish the workpiece.

23. A chemical mechanical polishing apparatus according to claim 20 further comprising a band-pass filter coupled to the sensor.

24. A chemical mechanical polishing apparatus according to claim 21 further comprising a band pass filter having a pass band of 50 to 1000 kHz coupled to the sensor.

25. A chemical mechanical polishing apparatus according to claim 21 further comprising a band pass filter having a pass band of at least 50 kHz coupled to the sensor.

26. A chemical mechanical polishing apparatus comprising:

a polishing pad for polishing a workpiece;

means for moving the polishing pad;

means for sensing acoustic emission energy generated at frequencies above 50,000 Hz during polishing and detecting a sudden and lasting change in the acoustic emission energy, and means for controlling the polishing pad to terminate polishing in response to detecting the sudden and lasting change in the acoustic emission energy.

27. A chemical mechanical polishing apparatus according to claim 26 further comprising a means for filtering for acoustic emission energy signals between 50 to 1000 kHz.

28. A chemical mechanical polishing apparatus according to claim 26 further comprising a means for filtering for acoustic emission energy signals greater than 50 kHz.

* * * * *